US011021835B2

(12) United States Patent
Zhao et al.

(10) Patent No.: US 11,021,835 B2
(45) Date of Patent: Jun. 1, 2021

(54) PORTABLE STAIN REMOVAL KIT

(71) Applicant: KONINKLIJKE PHILIPS N.V., Eindhoven (NL)

(72) Inventors: Lihong Zhao, Eindhoven (NL); Yile Liao, Eindhoven (NL); Yong Jiang, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/069,013

(22) PCT Filed: Oct. 31, 2017

(86) PCT No.: PCT/EP2017/077904

§ 371 (c)(1),
(2) Date: Jul. 10, 2018

(87) PCT Pub. No.: WO2018/083094

PCT Pub. Date: May 11, 2018

(65) Prior Publication Data

US 2019/0242053 A1 Aug. 8, 2019

(30) Foreign Application Priority Data

Nov. 1, 2016 (EP) ..... 16196680

(51) Int. Cl.
*C11D 17/04* (2006.01)
*C11D 3/39* (2006.01)
(Continued)

(52) U.S. Cl.
CPC ..... *D06F 43/002* (2013.01); *A47L 13/16* (2013.01); *A47L 13/26* (2013.01); *A47L 25/08* (2013.01); *B08B 3/08* (2013.01); *C11D 3/0047* (2013.01); *C11D 3/1233* (2013.01); *C11D 3/2086* (2013.01); *C11D 3/3707* (2013.01); *C11D 3/3753* (2013.01); *C11D 3/3761* (2013.01); *C11D 3/3769* (2013.01); *C11D 3/3942* (2013.01); *C11D 3/3955* (2013.01); *C11D 3/50* (2013.01); *C11D 11/0017* (2013.01); *C11D 17/049* (2013.01)

(58) Field of Classification Search
None
See application file for complete search history.

(56) References Cited

U.S. PATENT DOCUMENTS 3,416,879 A 12/1968 Sookne
3,528,115 A 9/1970 Lawes
(Continued)

FOREIGN PATENT DOCUMENTS

WO 9816622 A1 4/1998
WO 2005046423 A1 5/2005

*Primary Examiner* — Lorna M Douyon

(57) ABSTRACT

Portable stain removal kit (1) for locally removing a stained area on a fabric comprising a container (4) for containing a stain removing material (5) in a solid form, the container (4) being intended to be in direct contact with the stained area when the portable stain removal kit (1) is in use, whereby said portable stain removal kit (1) also comprises a base holder (3) for holding the container (4), and a cover (2) cooperating with the base holder (3) for enclosing the container (4) when the portable stain removal kit (1) is not in use.

14 Claims, 6 Drawing Sheets

(51) Int. Cl.

| | |
|---|---|
| ***C11D 3/395*** | (2006.01) |
| ***D06F 43/00*** | (2006.01) |
| ***A47L 25/08*** | (2006.01) |
| ***A47L 13/17*** | (2006.01) |
| ***C11D 11/00*** | (2006.01) |
| ***A47L 13/16*** | (2006.01) |
| ***A47L 13/26*** | (2006.01) |
| ***C11D 3/00*** | (2006.01) |
| ***C11D 3/12*** | (2006.01) |
| ***C11D 3/20*** | (2006.01) |
| ***C11D 3/37*** | (2006.01) |
| ***C11D 3/50*** | (2006.01) |
| ***B08B 3/08*** | (2006.01) |

(56) References Cited

U.S. PATENT DOCUMENTS

| | | | | |
|---|---|---|---|---|
| 5,765,407 | A | 6/1998 | Choo | |
| 6,514,924 | B1 | 2/2003 | Van Hauwermeiren | |
| 2002/0077266 | A1 | 6/2002 | Gabriel | |
| 2007/0051391 | A1 | 3/2007 | Wolff | |
| 2008/0166176 | A1* | 7/2008 | Rees | C11D 3/3955 401/196 |
| 2009/0163399 | A1* | 6/2009 | Corradini | C11D 17/041 510/296 |
| 2010/0101605 | A1* | 4/2010 | Saint Victor | A01N 25/34 134/6 |

* cited by examiner $$Na_2CO_3 \cdot 1.5H_2O_2 \xrightarrow[\text{water}]{} Na_2CO_3 + 1.5H_2O_2$$
FIG.5
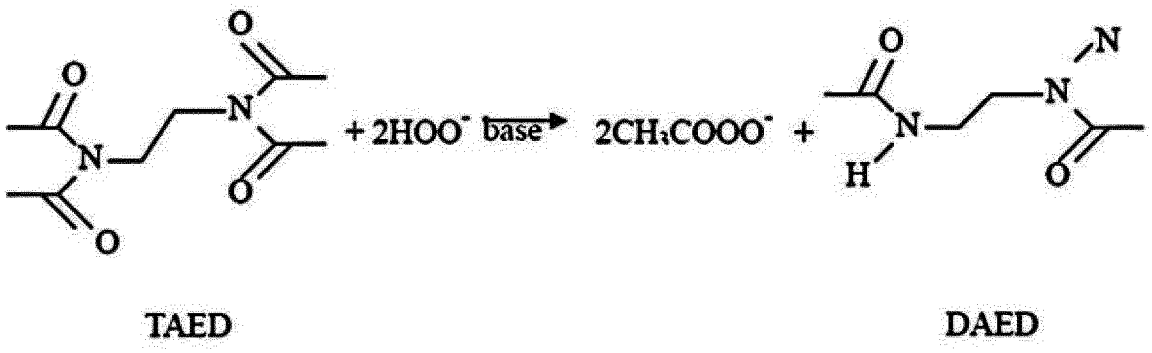
FIG.6
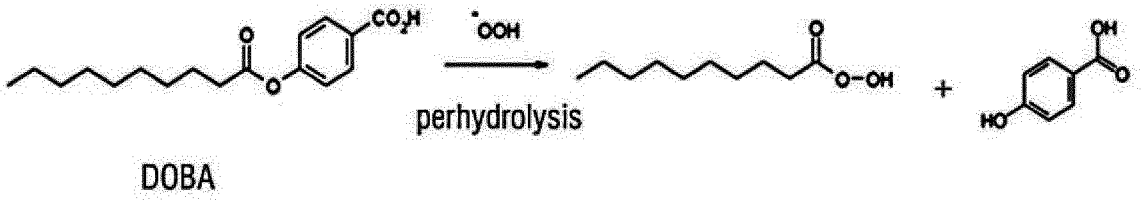
FIG.7

PORTABLE STAIN REMOVAL KIT

This application is the U.S. National Phase application under 35 U.S.C. § 371 of International Application No. PCT/EP2017/077904, filed on Oct. 31, 2017, which claims the benefit of International Application No. International Application No. 16196680.9 filed Nov. 1, 2016. These applications are hereby incorporated by reference herein.

FIELD OF THE INVENTION

The present invention relates to the field of stain removal, and relates in particular to a portable stain removal kit.

BACKGROUND OF THE INVENTION

Fabrics are common materials that can be used in such as garments and furnishing. They are typically able to absorb a fluid. This unique property means that they can be easily contaminated by contaminants such as food, drinks and writing markers, typically resulting in undesired spots on the fabric that cannot be easily removed without washing the fabric. These spots, which are often referred to as stains, may be removed through different burdensome processes.

In some cases, the stains may even require extensive local pre-treatment process prior to the laundry process. These are troublesome processes that can only take place when the whole fabric is due for washing.

There is thus a need for a solution allowing the removal of stain on the spot, and in a quick manner.

SUMMARY OF THE INVENTION

It is an object of the present invention to provide a portable stain removal kit that avoids or mitigates above-mentioned problems.

The invention is defined by the independent claims. The dependent claims define advantageous embodiments.

To this end, the portable stain removal kit according to the invention comprises:

- a container containing a stain removing material, the stain removing material being in a solid form, the container being intended to be in direct contact with the stained area when the portable stain removal kit is in use,
- a base holder for holding the container, and
- a cover cooperating with the base holder for enclosing the container when the portable stain removal kit is not in use.

The invention also relates to a method of removing a stained area using a portable stain removal kit as presented above, comprising the steps of:

- removing the cover for exposing the container,
- locating the portable stain removal kit under the fabric to allow direct contact between the container and the stained area, and
- applying water and/or steam and/or heat to the stained area.

The present invention is based on providing a portable stain removal kit and method to a user that allows stain treating by using a chemical medium. The portable stain removal kit is intended to cooperate with a user handheld device able to provide water and/or steam and/or heat and that are commonly found in any household, such as a garment steamer, or a garment iron.

The proposed portable stain removal kit and method uses a combination of a chemical, water and/or steam, and optionally heat. This allows both for a good stain removing speed and result. With this solution of stain removing, a stain spot can be removed effectively without the need for washing the whole piece of fabric. With the portable stain removal kit a stain on a garment may not only be treated chemically, but the stain may also be diluted and rinsed.

In other words, this solution allows users to locally treating a stain on a garment and remove the stain spot visibility quickly.

The fact that the stain removing material is in a solid form facilitates its storage and packaging in the container (as opposed to a stain removing material that would be in a liquid form), and has the advantage that it is more stable over time (i.e. it does not degrade). Moreover, manipulating the portable stain removal using a stain removing material in a solid form improves the user experience since leakage of liquid will not happen.

BRIEF DESCRIPTION OF THE DRAWINGS

These and other aspects of the invention will be apparent from and elucidated with reference to the embodiment(s) described hereinafter. In the following drawings FIG. 5 shows the chemical formation of $H_2O_2$ from sodium percarbonate, FIG. 6 shows the chemical formation of peroxy acid from TAED, FIG. 7 shows the chemical formation of peroxy acid DOBA.

DETAILED DESCRIPTION OF THE INVENTION

Figure 1:
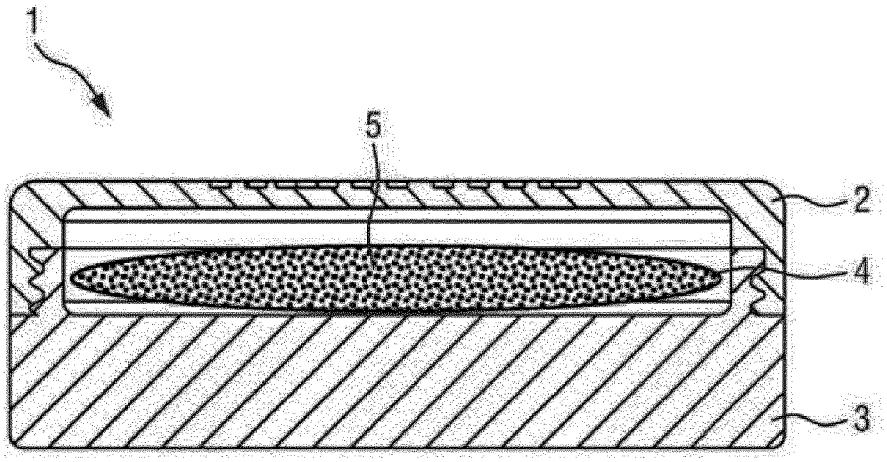
FIG. 1 shows a side view of an exemplary embodiment of a portable stain removal kit according to the present invention when not in use.
Figure 2:
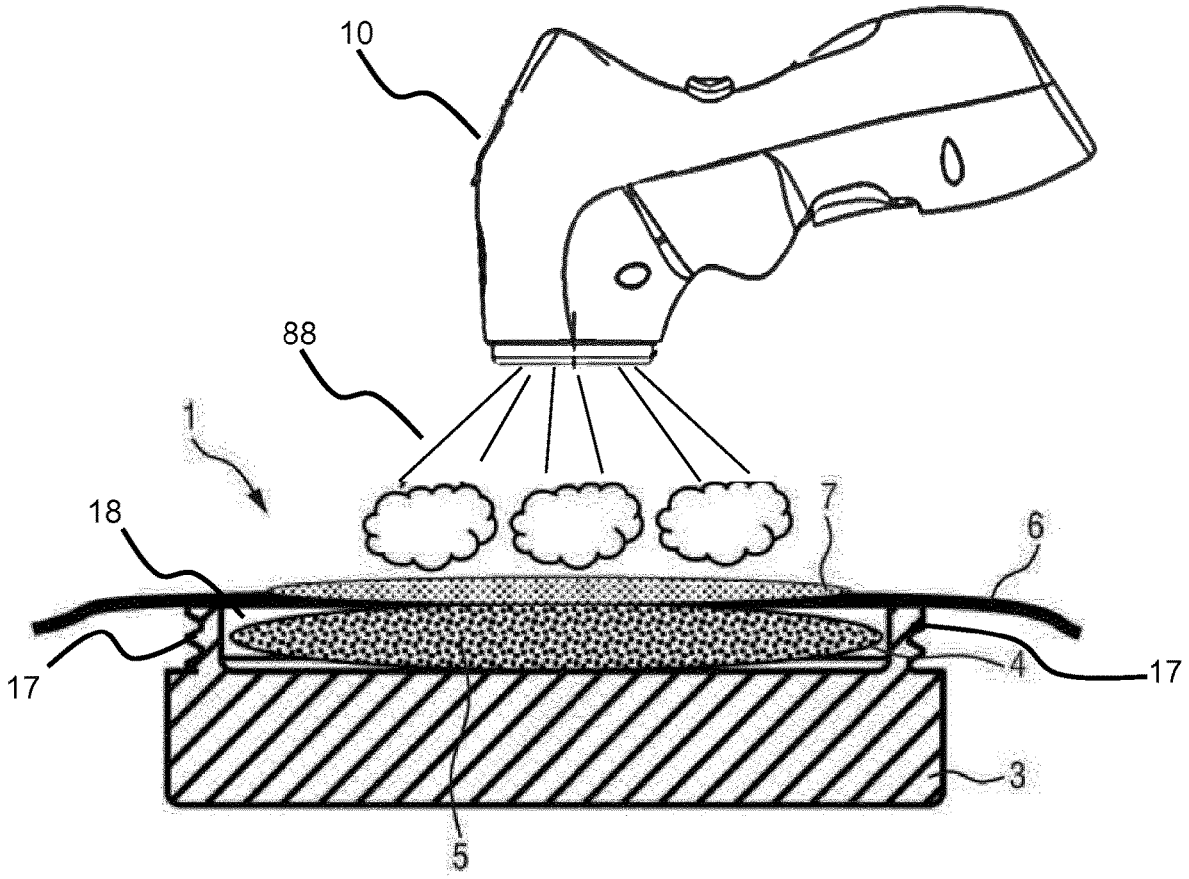
FIG. 2 shows a side view of an exemplary embodiment of a portable stain removal kit according to the present invention during stain treatment.

FIG. 1 and FIG. 2 depict a portable stain removal kit 1 according to the invention for locally removing a stained area 7 on a fabric 6.

The portable stain removal kit 1 comprises:

- a container 4 containing a stain removing material 5, the stain removing material 5 being in a solid form, the container 4 being intended to be in direct contact with the stained area when the portable stain removal kit 1 is in use,
- a base holder 3 for holding the container 4, and
- a cover 2 cooperating with the base holder 3 for enclosing the container 4 when the portable stain removal kit 1 is not in use.

FIG. 1 shows a side view of an exemplary embodiment of a portable stain removal kit 1 according to the present invention when not in use (for example during storage). When the portable stain removal kit is not in use, the cover 2 covers the container 4 which is held by the base holder 3. The cover protects the container 4 and ensures that the kit 1 can conveniently be carried around.

FIG. 2 shows a side view of an exemplary embodiment of a portable stain removal kit according to the present invention 1 when in use (i.e. during stain treatment).

The portable stain removal kit 1 is intended to cooperate with a handheld device 10, such as a handheld garment steamer, as illustrated. Alternatively, the handheld device 10 could correspond to a steam iron (not shown) or an equivalent device.

In this embodiment, the cover 2, which is intended to be removed, is removed (i.e. detached). A piece of fabric 6 comprising a stained area 7 is placed directly onto the container 4 containing stain removing material 5. Water and/or steam, and optionally heat, being generated by the handheld device 10, is applied to the stained area 7 of the fabric 6.

When the stained area 7 of the fabric 6, for example a garment, and the container 4 are placed in contact with each other, treatment of the stained area 7 is initiated by means of applying by user water and/or steam (illustrated by ref. 8), and optionally applying heat, for example by using device 10.

The stain removing material 5 in solid form refers to a material that can either be a hard and non-deformable material (such as an agglomerated compound), granule form, powder form, gel form or a paste form:

- Powder: it comprises bleach chemical powder or mixture of powder,
- Granule: it comprises bleach chemical granules or mixture of granule,
- Gel: it comprises hydrogen peroxide solution mixed with solvent and gelling agents,
- Paste: it comprises hydrogen peroxide solution mix with surfactant or polymer; peroxide powder like sodium peroxide mix with surfactant or polymer.

In other words, the stain removing material 5 can take any solid form, except a liquid form.

The base holder 3 comprises a liquid receiving portion 18, and the container 4 is arranged into the liquid receiving portion 18. For example, the liquid receiving portion 18 is formed by lateral edges 17 surrounding the container 4, but the liquid receiving portion 18 could also be any concave portion formed in the bottom part of the base holder 3.

Preferably, the container 4 takes any of the forms defined by a bag, a pad, a cartridge, a sachet, and a capsule. The choice of the container form may depend on the user's heating or steaming device chosen, on the kind of stain to be treated and in this respect also on the amount of stain removing material needed to treat the stain. Accordingly, the size and the shape of the container may also be different.

In yet another embodiment, the container is made from material chosen from high density paper, fabric, non-woven fabric, and porous plastic. All those material are fluid-permeable. This is important because steam/water need to enter/penetrate the container to react with the stain removal material in the container in order to produce the chemical solution, and the chemical solution need to be released from the container to be used in treating s stain on the fabric.

In yet a further embodiment of the portable stain removal kit the container furthermore comprises fragrance and/or perfume agents. This may create a better user perception. For example, the container may release a scent reminding the user of hygiene and cleaning or it may give the user an impression of freshening.

Figure 3:
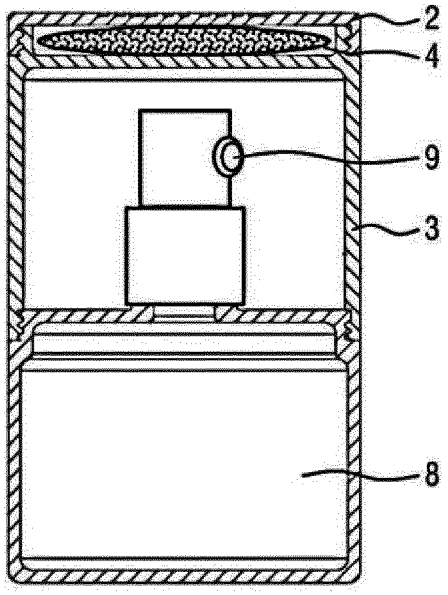
FIG. 3 shows a side view of another exemplary embodiment of a portable stain removal kit according to the present invention when not in use.
Figure 4:
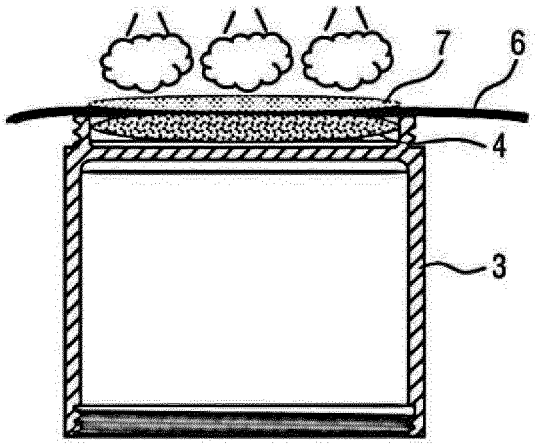
FIG. 4 shows a side view of an exemplary embodiment of a portable stain removal kit according to the present invention during stain treatment.

FIG. 3 and FIG. 4 depict another exemplary of a portable stain removal kit according to the invention for locally removing a stained area 7 on a fabric 6. For sake of clarity, the handheld device 10 in tended to cooperate with the portable stain removal kit is not represented on FIG. 4.

FIG. 3 shows a side view when the portable stain removal kit is not in use, for example during storage.

The portable stain removal kit comprises a cover 2, a container 4 containing a stain removing material, a base holder 3, a liquid tank 8 and a dispensing mechanism 9 for dispensing liquid being in the liquid tank 8. For example the dispensing mechanism may comprise a pressure based nozzle, a velocity based nozzle, a spray, and dripping by gravity or any exerted force.

During storage, the cover 2, the base holder 3 and the liquid tank 8 are assembled together. The container 4 is enclosed between the cover 2 and the base holder 3, similarly as in the embodiment of FIG. 1 and FIG. 2. The base holder 3 comprises the dispensing mechanism 9 and the liquid tank 8.

The liquid tank 8 is configured to contain water and/or a chemical neutralizer and the dispensing mechanism is configured to dispense said water and/or chemical neutralizer from the liquid tank 8 to a stained area 7 on the fabric 6, as illustrated in FIG. 2.

Implementing an integrated water tank and dispensing mechanism provides extra convenience to the user because water needed for dissolving some stain removing materials has not to be provided from external sources.

FIG. 4 shows a side view of the portable stain removal kit during stain treatment. In this stage, the cover 2 is removed. The stained area 7 is placed on the container 4. The steam and/or heat 88 is also required to be applied to the stained fabric 6 during treatment, similarly as in the embodiment of FIG. 1 and FIG. 2.

Preferably, the cover 2 is fluid-impermeable. The cover is used to cover and hold the possibly wetted container inside, therefore protecting materials that may come into contact with the container from chemical attacks, contamination or other damages caused by the wet of the container. The cover also prevents the stain removal material in the container from reacting with moisture in the ambient air during storage.

Preferably, the base holder 3 is fluid-impermeable. This provides protection to operation tables, desks or other bases from chemical attacks and contamination or other damages caused by liquids.

Figure 10A:
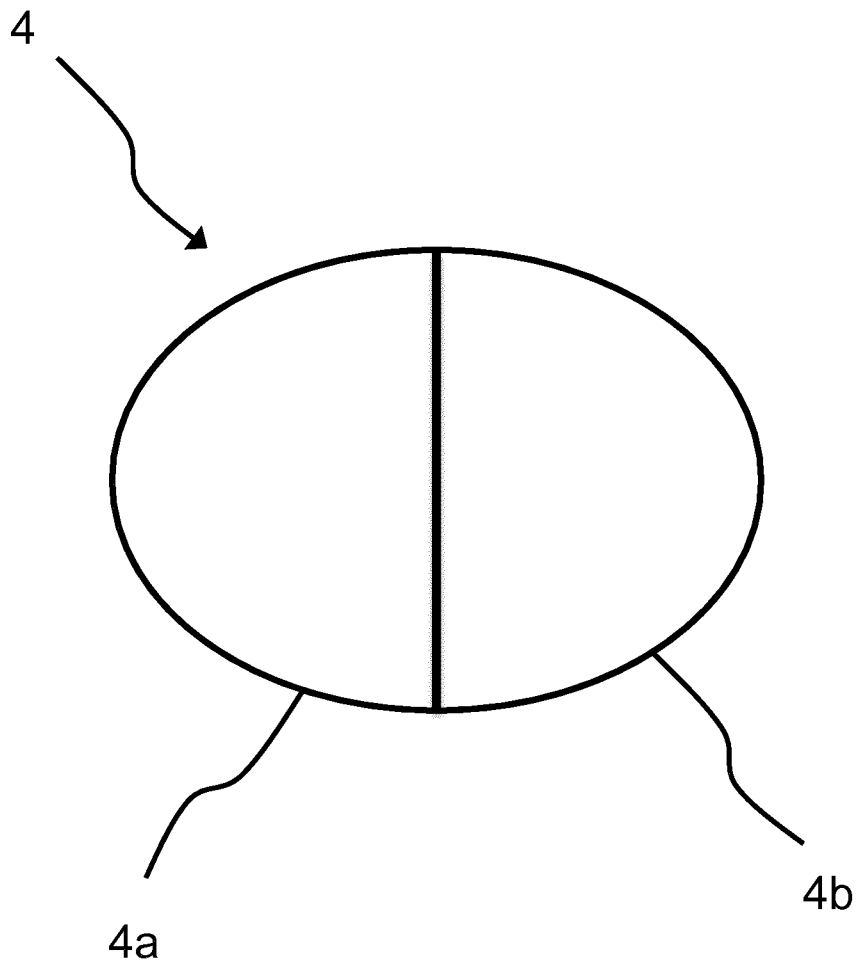
FIG. 10B shows different view of a container according to the present invention for containing different stain removing materials.
Figure 10B:
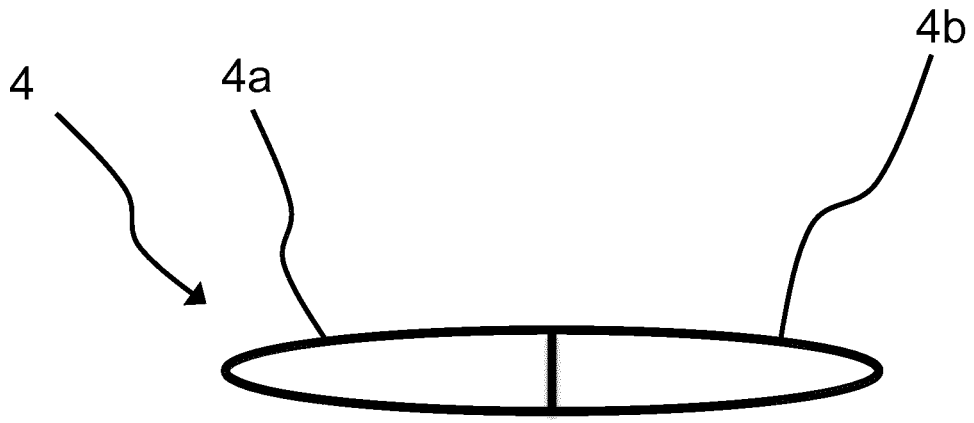

FIG. 10A and FIG. 10B shows different view of a container 4 according to the present invention for containing different stain removing materials. FIG. 10A is a front view, while FIG. 10B is a cross-section view.

The container 4 of the stain removal material kit is divided into at least two compartments 4*a* and 4*b* for storing different stain removing materials, for example material A and material B. This serves to treat different kind of stains with a single container in an optimal way.

In this example, material A is contained in compartment 4*a*. It can be a single component or a mixture. Material B is contained in compartment 4*b* which also can be a single component or a mixture.

Stain cloth can be laid on compartment A to have the first treatment and move on to compartment B for a second treatment if stain is not completely removed at the first treatment.

Although material A and B can co-exist and mix together in a dry solid form, once in contact with water, A and B can affect or react with each other thus compromise the overall stain remover effect. If A and B are separated while doing the stain treatment with water, better stain removal result can be achieved.

For example, material A is a bleach and bleach activator, and material B is enzyme. Stain can be firstly treated by compartment A with heating and water to oxidize all the color molecules in the stain, and then continue the treatment with compartment B to let enzyme breakdown the protein molecules in the stain. Heating must be turned off or lower down to <50 degree C. to while doing treatment at compartment B as enzyme' activity is reduced at high temperature.

FIG. 5 shows the chemical formation of $H_2O_2$ from sodium percarbonate.

FIG. 6 shows the chemical formation of the peroxy acid from TAED (Tetraacetylethylenediamine, $C_{10}H_{16}N_2O_4$).

FIG. 7 shows the chemical formation of the peroxy acid from DOBA (4-Decanoyloxybenzoic acid, C17H24O4).

In an embodiment of the portable stain removal kit the stain removing material comprises an active oxygen source.

In an embodiment of this portable stain removal kit, the active oxygen source comprises any one of hydrogen peroxides with formula $H_2O_2$, sodium percarbonate with formula $Na_2CO_3.1.5H_2O_2$, and sodium perborate with formula $NaBO_3.H_2O$ or $NaBO_3.4H_2O$.

In another embodiment, the stain removal material 5 further comprises a bleach activator.

The bleach activators are used to reduce the energy consumption of the bleaching process, particularly to reduce the process temperature. Bleach activators and catalysts are compounds that react with hydrogen peroxide in aqueous solution to form peroxy acids. Bleach activators are in solid form, for example powder. Unlike the pure hydrogen peroxide bleaching process, the peroxy acids are able to produce good results even at temperatures below 60° C. Therefore, bleach activators are used here just like in common components of most laundry detergents.

The active oxygen source (the bleach) and the bleach activator are both in solid form (i.e. not liquid form), and they can for example co-exist in a mixed powder. In a dry, solid state, the bleach and bleach activator are stable. Reaction would not take place until a contact with water or moisture is made.

In an embodiment of the portable stain removal kit, the bleach activator comprises any one of (taken alone or in combination):

- tetraacetylethylenediamine (TAED),
- 4-decanoyloxybenzoic acid (DOBA),
- sodium salt of nonanoyloxybenzenesulphonic acid (NOBS),
- sodium salt of 3,5,5-trimethylhexanoyloxyphenylsulfonic acid (iso-NOBS),
- sodium salt of acetoxyphenylsulfonate,
- sodium decanoyloxybenzene sulfonic acid (DOBS), sodium octanoyloxybenzene sulfonic acid (OOBS),
- GOBS,
- sodium nonanoyloxybenzoic acid (NOBA),
- N,N-Diacetylethylenediamine,
- N-[4-(triethylammoniomethyl) benzoyl]butyrolactam-chloride (TBBC),
- sodium trimethylhexanoyloxybenzenesulfonate (STHOBS),
- sodium-4-benzoyloxybenzenesulfonate (SBOBS),
- glucose pentaacetate (GPA),
- tetraacetylglucoluril (TAGU),
- nitrilotriacetate (NTA),
- transition metal bleach catalyst etc.

Figure 8A:
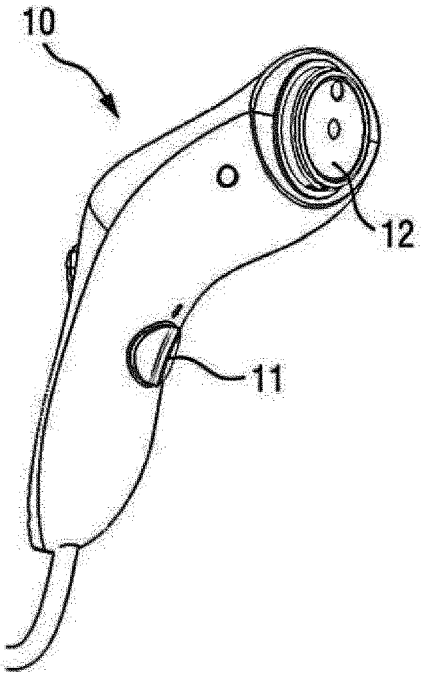
FIGS. 8A and 8B show different views of a hand-held device intended to cooperate with a portable stain removal kit according to the present invention.
Figure 8B:
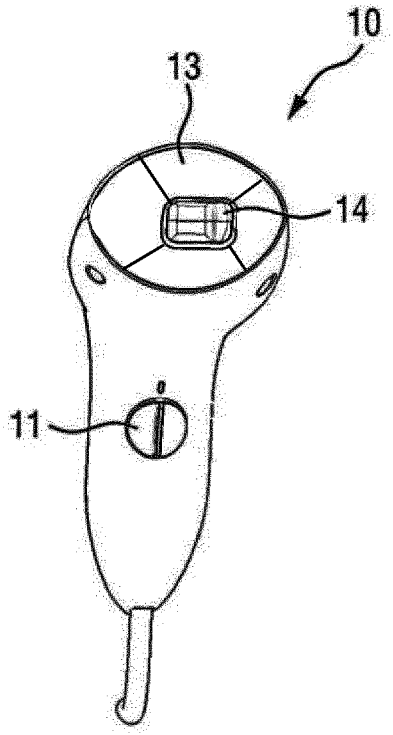

FIGS. 8A and 8B show different views of a hand-held device 10 intended to cooperate with a portable stain removal kit according to the present invention.

FIG. 8A shows a side view of a hand-held device 10, while FIG. 8B shows a front view of the hand-held device 10.

The device 10 is intended to be used in connection with the portable stain removal kit FIG. 1 or FIG. 3 for removing a stain on a fabric. The device 10 may release water and/or steam, and preferably produce heat.

The device 10 comprises:

- a device liquid tank 11 for containing water and/or a chemical neutralizer,
- a dispensing mechanism (not shown) for dispensing water and/or steam and/or chemical neutralizer out of the liquid tank onto the fabric to rinse the stained area, and
- a heater, for example a heating plate 12, for heating the stained area on the fabric and/or water for generating steam, and/or heating the chemical neutralizer.

The chemical neutralizer is preferably used after stain treatment bleaching, for stopping the bleaching reaction.

Dealing with the embodiments of FIG. 1 or FIG. 3, a stained garment is placed onto the container 4 of the portable stain removal kit.

In order to start treating the stain, the stained area needs to be wetted (by water and/or steam) and/or heated, for example by a hand-held device 10.

In particular, the stained area 7 may be wetted with water and/or steam from the device liquid tank 11 by means of the dispensing mechanism.

Heat may also be provided by the heating plate 12. This allows the chemicals in the container 4 work efficiently and faster on stain removal. The functions of releasing steam and water may not only be used for dissolving stain removing materials contained in the container 4, but also later for rinsing the stained area after the stained area has been treated with the portable stain removal kit.

The hand-held device 10 may also comprise a guide head 13 to gather steam into a spout 14 facing the stain on the fabric. The guide head 13 is used to target the stain spot more efficiently.

Figure 9:
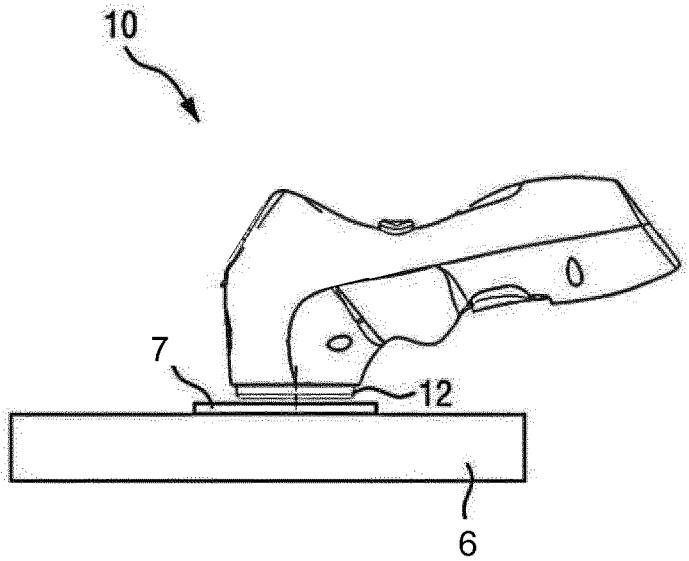
FIG. 9 shows a hand-held device used during treating a stain on a fabric, FIG. 10A

FIG. 9 shows a hand-held device 10 during the process of stain treatment.

In particular, the heated plate 12 faces and gets into contact with the fabric 6 for:

- Heating the stained area 7 during stain removing for accelerating the bleaching, and/or
- Heating the treated stained area 7 after stain removing and/or rinsing of the treated stained area, in order to dry the stained area.

Figure 11:
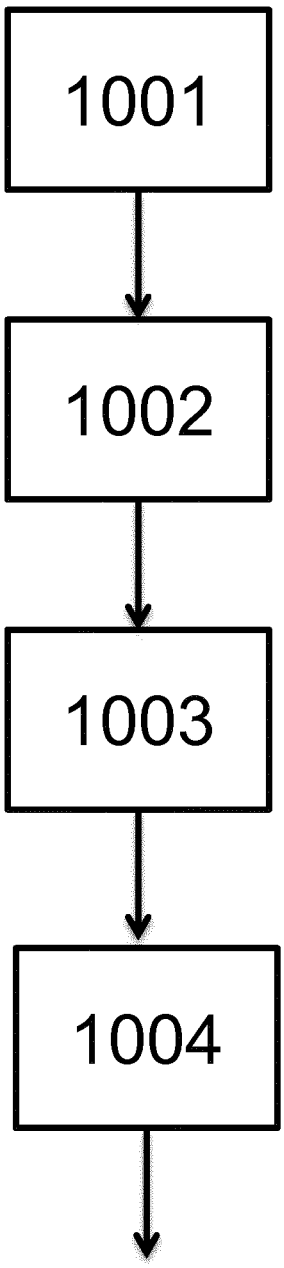
FIG. 11 depicts a flow chart of a method according to the invention.

FIG. 11 depicts a flow chart of a method according to the invention, of removing a stained area using a portable stain removal kit (1) as described along with FIG. 1-2-3-4. The method comprises the steps of:

- removing 1001 the cover 2 for exposing the container 4,
- locating 1002 the portable stain removal kit 1 under the fabric 6 to allow direct contact between the container 4 and the stained area, and
- applying 1003 water and/or steam and/or heat to the stained area 7.

Preferably, the method further comprises the step of:

- using 1004 the dispensing mechanism 9 for dispensing water and/or chemical neutralizer from the liquid tank 8 onto the stained area 7.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A portable stain removal kit for locally removing a stained area on a fabric, comprising:

a container containing a stain removing material, the stain removing material being in a solid form, the container having an upper surface for being in direct contact with an underside fabric surface of the stained area when the portable stain removal kit is in use, a base holder having a liquid receiving portion, wherein the base holder supports and holds the container within the liquid receiving portion via a lower surface of the liquid receiving portion, wherein a top surface of lateral edges of the liquid receiving portion and a portion of the upper surface of the container are aligned with one another, and a cover that cooperates with the base holder for enclosing the container within the liquid receiving portion of the base holder when the portable stain removal kit is not in use, and for uncovering the container within the liquid receiving portion of the base holder when the portable stain removal kit is in use, wherein the container is fluid-permeable, so to allow steam and/or water to enter/penetrate the container to react with the stain removing material in the container in order to produce a chemical solution, and wherein the liquid receiving portion supports and holds the container from underneath, via the lower surface of the liquid receiving portion, when the stain removing material of the container is in use for locally removing the stained area on the fabric.

2. The portable stain removal kit according to claim 1, wherein the stain removing material comprises an active oxygen source.

3. The portable stain removal kit according to claim 2, wherein the active oxygen source comprises any one of hydrogen peroxides with formula $H_2O_2$; sodium percarbonate with formula $Na_2CO_3.1.5H_2O_2$, and sodium perborate with formula $NaBO_3.H_2O$ or $NaBO_3.4H_2O$.

4. The portable stain removal kit according to claim 1, wherein the stain removal material further comprises a bleach activator.

5. The portable stain removal kit according to claim 4, wherein the bleach activator comprises any one of:

tetraacetylethylenediamine (TAED), 4-decanoyloxybenzoic acid (DOBA), sodium salt of nonanoyloxybenzenesulphonic acid (NOBS), sodium salt of 3,5,5-trimethylhexanoyloxyphenylsulfonic acid (iso-NOBS), sodium salt of acetoxyphenylsulfonate, sodium decanoyloxybenzene sulfonic acid (DOBS), sodium octanoyloxybenzene sulfonic acid (OOBS), sodium nonanoyloxybenzoic acid (NOBA), N,N-Diacetylethylenediamine, N-[4-(triethylammoniomethyl) benzoyl]butyrolactam-chloride (TBBC), sodium trimethylhexanoyloxybenzenesulfonate (STHOBS), sodium-4-benzoyloxybenzenesulfonate (SBOBS), glucose pentaacetate (GPA), tetraacetylglucoluril (TAGU), nitrilotriacetate (NTA), transition metal bleach catalyst.

6. The portable stain removal kit according to claim 1, wherein the container takes any of the forms defined by a bag, a pad, a cartridge, a sachet, and a capsule.

7. The portable stain removal kit according to claim 1, wherein the container is made of a material taken from any one of high density paper, fabric, non-woven fabric, and porous plastic.

8. The portable stain removal kit according to claim 1, wherein the container further comprises fragrance and/or perfume agents.

9. The stain removal kit according to claim 1, wherein the container is divided into at least two compartments for storing different stain removing materials.

10. The portable stain removal kit according to claim 1, wherein the base holder and/or the cover are fluid-impermeable.

11. The portable stain removal kit according to claim 1, further comprising:

a liquid tank for containing water and/or a chemical neutralizer, and a dispensing mechanism for dispensing said water and/or chemical neutralizer from the liquid tank to the stained area.

12. The portable stain removal kit according to claim 11, wherein the dispensing mechanism corresponds to any one of a pressure based nozzle, a velocity based nozzle, a spray, and dripping by gravity.

13. A method of removing a stained area using a portable stain removal kit according to claim 1 comprising:

removing the cover for exposing the container, locating the portable stain removal kit under the fabric to allow direct contact between the container and the underside fabric surface of the stained area, and applying water and/or steam and/or heat to the stained area.

14. The method as claimed in claim 13, wherein the portable stain removal kit further comprises:

a liquid tank for containing water and/or a chemical neutralizer, and a dispensing mechanism for dispensing said water and/or chemical neutralizer from the liquid tank to the stained area;

the method further comprising the step of:

using the dispensing mechanism for dispensing water and/or chemical neutralizer from the liquid tank onto the stained area.

* * * * *